US007950542B2

(12) United States Patent
Steadman

(10) Patent No.: US 7,950,542 B2
(45) **Date of Patent: *May 31, 2011**

(54) RECESSED OPENING ASSEMBLY APPARATUS

(76) Inventor: William David Steadman, Port Saint Lucie, FL (US)

( * ) Notice: Subject to any disclaimer, the term of this patent is extended or adjusted under 35 U.S.C. 154(b) by 1014 days.

This patent is subject to a terminal disclaimer.

(21) Appl. No.: 11/392,080

(22) Filed: Mar. 29, 2006

(65) Prior Publication Data

US 2006/0163253 A1 Jul. 27, 2006

Related U.S. Application Data

(63) Continuation-in-part of application No. 10/467,255, filed as application No. PCT/GB02/00274 on Jan. 23, 2002, now Pat. No. 7,051,896.

(30) Foreign Application Priority Data

Feb. 12, 2001 (GB) ..... 0103404.0

(51) Int. Cl.
*B65D 41/06* (2006.01)
*B65D 41/36* (2006.01)
*B65D 17/34* (2006.01)

(52) U.S. Cl. ..... 220/294; 220/304; 220/254.8; 220/708; 220/906

(58) Field of Classification Search ..... 220/294, 220/304, 906, 254.8, 708; 215/235, 253
See application file for complete search history.

(56) References Cited

U.S. PATENT DOCUMENTS

| | | | | |
|---|---|---|---|---|
| 631,907 | A | 8/1899 | Schmalenbach | 220/210 |
| 638,258 | A | 6/1950 | Armstrong | |
| 2,733,052 | A | 1/1956 | Luther | 366/205 |
| 2,749,618 | A | 6/1956 | Landon | 33/414 |
| 2,974,824 | A | 3/1961 | Etsuo | 220/271 |

(Continued)

FOREIGN PATENT DOCUMENTS

DE 8336770 U 2/1984

(Continued)

OTHER PUBLICATIONS

International Search Report—4 pages, Sep. 19, 2008, William David Steadman.

*Primary Examiner* — Anthony Stashick
*Assistant Examiner* — James N Smalley
(74) *Attorney, Agent, or Firm* — Tarolli, Sundheim, Covell & Tummino LLP

(57) ABSTRACT

The present disclosure is directed to a beverage container having an opening assembly apparatus and method having an advanced design for sealing the contents within the container after opening. The opening assembly includes a lid having a top and bottom side, the lid being attached to a receptacle for containing the beverage contents, and a recess located about the top side of the lid for facilitating the filling of the receptacle. An aperture is located about the recess and projecting from the aperture is an undulating flange on the bottom side of the lid. A closure member coactively engaging the aperture and recess to provide a sealing engagement by inserting a first portion of the closure member into the recess and a second portion of the closure member into the aperture and rotating the closure member from an opened position to a closed position. The closure member includes a breakable seal for providing security that the container is tamper free.

5 Claims, 6 Drawing Sheets

U.S. PATENT DOCUMENTS

| | | | | | |
|---|---|---|---|---|---|
| 3,106,311 | A | | 10/1963 | Bradley | |
| 3,173,566 | A | | 3/1965 | Talbert | |
| 3,262,612 | A | | 7/1966 | Tabor | 222/484 |
| 3,289,881 | A | | 12/1966 | Ganung | 220/254.1 |
| 3,331,638 | A | | 7/1967 | Fruth | 301/108.2 |
| 3,473,692 | A | | 10/1969 | Moller | 220/265 |
| 3,659,738 | A | | 5/1972 | Friedmann et al. | 220/287 |
| 3,672,547 | A | | 6/1972 | Kozlowski | 222/567 |
| 3,704,804 | A | | 12/1972 | Kaercher et al. | |
| 3,746,197 | A | * | 7/1973 | Sather | 215/388 |
| 3,784,047 | A | | 1/1974 | Cooper | 220/301 |
| 3,843,011 | A | | 10/1974 | Perry | |
| 3,877,604 | A | | 4/1975 | Brown | 220/267 |
| 3,945,529 | A | | 3/1976 | Haag | 220/254.1 |
| 3,952,911 | A | | 4/1976 | Bozek et al. | 220/269 |
| 4,043,474 | A | | 8/1977 | McCord | 215/211 |
| 4,171,057 | A | | 10/1979 | Gach | 215/211 |
| 4,179,038 | A | | 12/1979 | Rosan | 220/243 |
| 4,224,017 | A | | 9/1980 | Kayne | 431/291 |
| 4,265,363 | A | | 5/1981 | Conn | |
| 4,516,683 | A | | 5/1985 | Delia | 215/211 |
| 4,605,141 | A | | 8/1986 | Won | |
| 4,640,435 | A | | 2/1987 | Dutt | |
| 4,747,511 | A | | 5/1988 | Dutt et al. | 220/254.2 |
| 4,915,252 | A | | 4/1990 | Schaffer | 220/791 |
| 5,080,249 | A | | 1/1992 | Shock | |
| 5,123,561 | A | * | 6/1992 | Gross | 222/153.07 |
| 5,443,175 | A | | 8/1995 | Kelly et al. | 220/298 |
| 5,586,681 | A | | 12/1996 | Policappelli | |
| 6,106,757 | A | | 8/2000 | Ohlsson et al. | 264/251 |
| 6,116,446 | A | * | 9/2000 | Haughton et al. | 215/355 |
| 6,138,854 | A | | 10/2000 | Kaneko et al. | |
| 2002/0088804 | A1 | * | 7/2002 | Omura | 220/269 |
| 2002/0108922 | A1 | * | 8/2002 | Hierzer | 215/235 |

FOREIGN PATENT DOCUMENTS

| | | | |
|---|---|---|---|
| FR | 2 375 101 | A | 7/1978 |
| FR | 2651749 | A | 3/1991 |
| GB | 638258 | A | 6/1950 |
| GB | 2 234 426 | A | 4/1990 |
| GB | 2 254 070 | A | 9/1992 |
| GB | 2309682 | A | 8/1997 |
| GB | 2 342 341 | A | 4/2000 |
| WO | WO 9911523 | A | 3/1999 |
| WO | WO 01/05663 | A2 | 1/2001 |

* cited by examiner

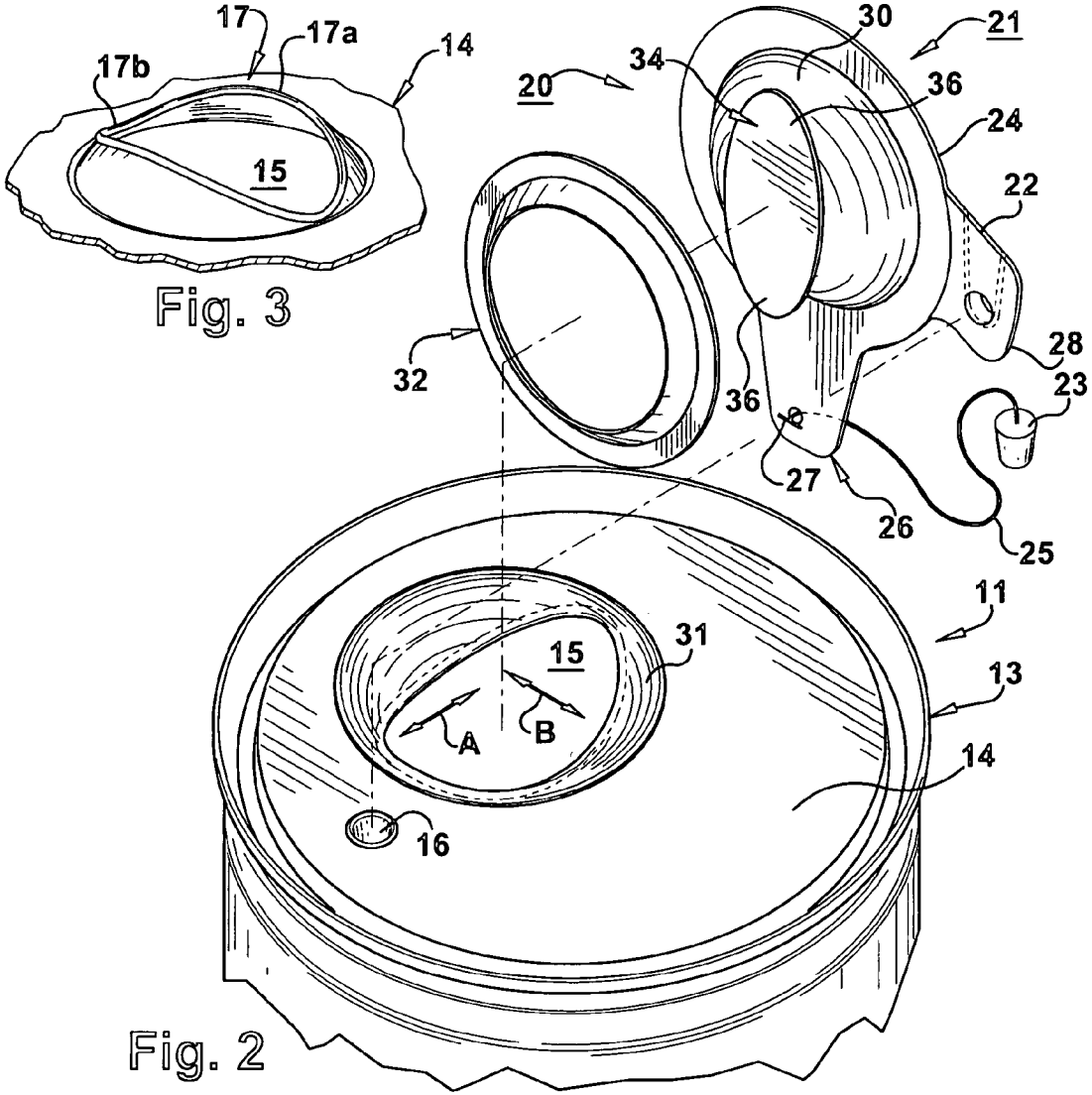
Fig. 2
Fig. 3
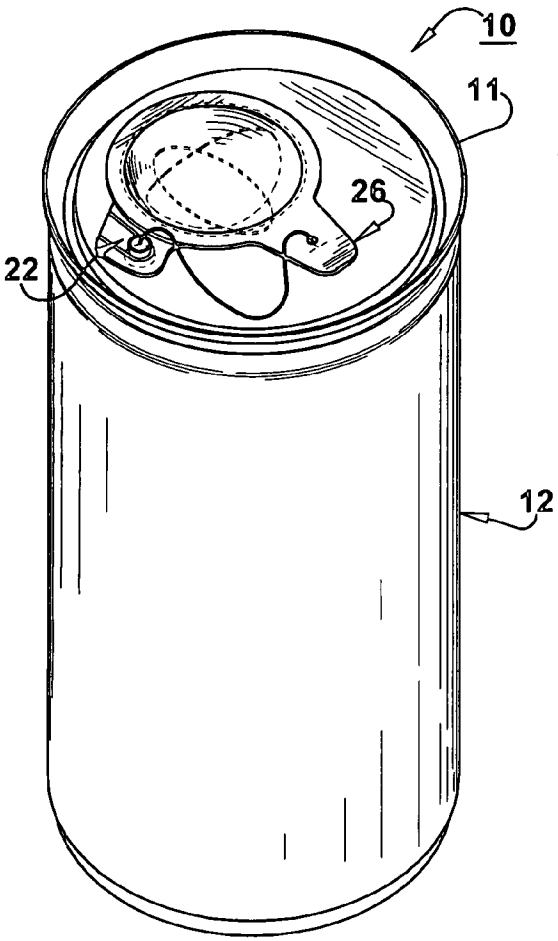
Fig. 1

RECESSED OPENING ASSEMBLY APPARATUS

CROSS-REFERENCES TO RELATED APPLICATIONS

The present application is a continuation-in-part application containing common subject matter as previously filed and application Ser. No. 10/467,255, filed in the U.S. Patent and Trademark Office on Aug. 5, 2003, entitled "OPENING ASSEMBLY" now issued U.S. Pat. No. 7,051,896 issued May 30, 2006, which claims priority from International PCT Application Serial. No. PCT/GB02/00274, filed on Jan. 23, 2002, entitled "OPENING ASSEMBLY", which claims priority to United Kingdom Patent Application Serial No. GB0103404.0 filed in on Feb. 12, 2001. The entirety of the aforementioned patents and patent applications are incorporated herein by reference for all purposes.

FIELD OF THE INVENTION

This invention relates to opening assemblies for beverages containers, and more specifically, opening assemblies apparatus and methods for making beverage containers.

BACKGROUND OF THE INVENTION

Different forms of opening assemblies have evolved over the years. One type of container conventionally used for carbonated beverages is a can with a ring pull arrangement. While such containers have proved very popular, a number of disadvantages can be encountered with them. For instance, it is not possible to close the can once opened, and the contents therefore have to be consumed at one time. This can be a particular problem with children or when travelling, in that a container could for instance be knocked over and therefore the contents spilt. Also there is a potential hygiene problem as the top of the cans can become dirty, and this part can come into contact with some of the can's contents and/or a person drinking from the can.

A second type of container includes those used with molded plastic bottles, it is generally necessary for the bottles to be relatively tall with a screw thread molded at the upper end. It is generally not possible to vary the thickness of the body other than at the upper end, and therefore strengthening portions and internal thickening cannot be provided. Accordingly, only relatively tall shapes are usually produced, as these have adequate strength. Shipping drinks in either such containers takes up a significant volume and weight, and hence adds to the costs for such products A number of manufacturing disadvantages are encountered with the present arrangements for such containers. For instance, with ring pull cans, relatively complex and expensive machinery is required to mount the closure arrangements on the can bodies following filling. This generally prevents smaller concerns from producing drinks in such containers. Similarly, significant costs barriers preclude entry for retailers and small concerns into beverage container assembly, which today for metal containers is typically processed by expensive combined filling and spin lid sealing machines.

Accordingly, a need has evolved for a more economical and end-user friendly opening assembly that will reduce cost, weight, and storage space during shipping. In addition, a need has developed for a low cost assembly of the beverage containers such that it allows retailers or small business concerns to fill the containers at point-of-sale locations without incurring costs from expensive capital equipment.

SUMMARY OF THE INVENTION

The present disclosure is directed to a beverage container with an opening assembly apparatus and method having an advanced design for sealing the contents within the container after opening. The opening assembly includes a lid having a top and bottom side, the lid being attached to a receptacle for containing the beverage contents, and a recess located about the top side of the lid for facilitating the filling of the receptacle. An aperture is located about the recess and projecting from the aperture is an undulating flange on the bottom side of the lid. A closure member coactively engaging the aperture and recess to provide a sealing engagement by inserting a first portion of the closure member into the recess and a second portion of the closure member into the aperture and rotating the closure member from an opened position to a closed position. The recess in the lid in one embodiment is responsible for the geometric configuration of the undulating flange.

The opening assembly of the closure member includes a breakaway portion secured to the lid by a projection fixedly engaged to a depression in the lid to provide security to a consumer that the product is tamper free. The breakaway portion fractures upon initial opening by the consumer when an arm on the opening assembly is rotated to an opening position. The projection also assists in retaining the closure member to the container via a cord connection.

An additional feature of the opening assembly is a reinforced surface located above and along the contact portion of the undulating flange. The additional support surface is achieved in one embodiment by forming a reinforcing lip about the flange during a pressing or stamping operation. In another embodiment the reinforced surface is achieved by adding additional material during a forging or molding process. Another feature of the opening assembly adds structural support by the addition of ribs formed in the lid geometry.

In another embodiment, the container encases a straw within the body of the receptacle when the container is closed. Removing the closure member allows the straw to protrude through the aperture for consumer usage. The closure member includes a recess for housing the straw while the opening assembly is in the closed position.

These and other advantages and features of the exemplary embodiment of the recessed opening assembly are described in detail in conjunction with the accompanying drawings.

BRIEF DESCRIPTION OF THE DRAWINGS

FIG. 1 is a perspective view of a beverage container depicting an opening assembly in a closed position;

FIG. 2 is a diagrammatic view of the beverage container depicting an opening assembly;

FIG. 3 is a perspective cut-away view of the underside of the beverage container lid depicting an undulating flange;

DETAILED DESCRIPTION OF THE PREFERRED EMBODIMENTS

Figure 13:
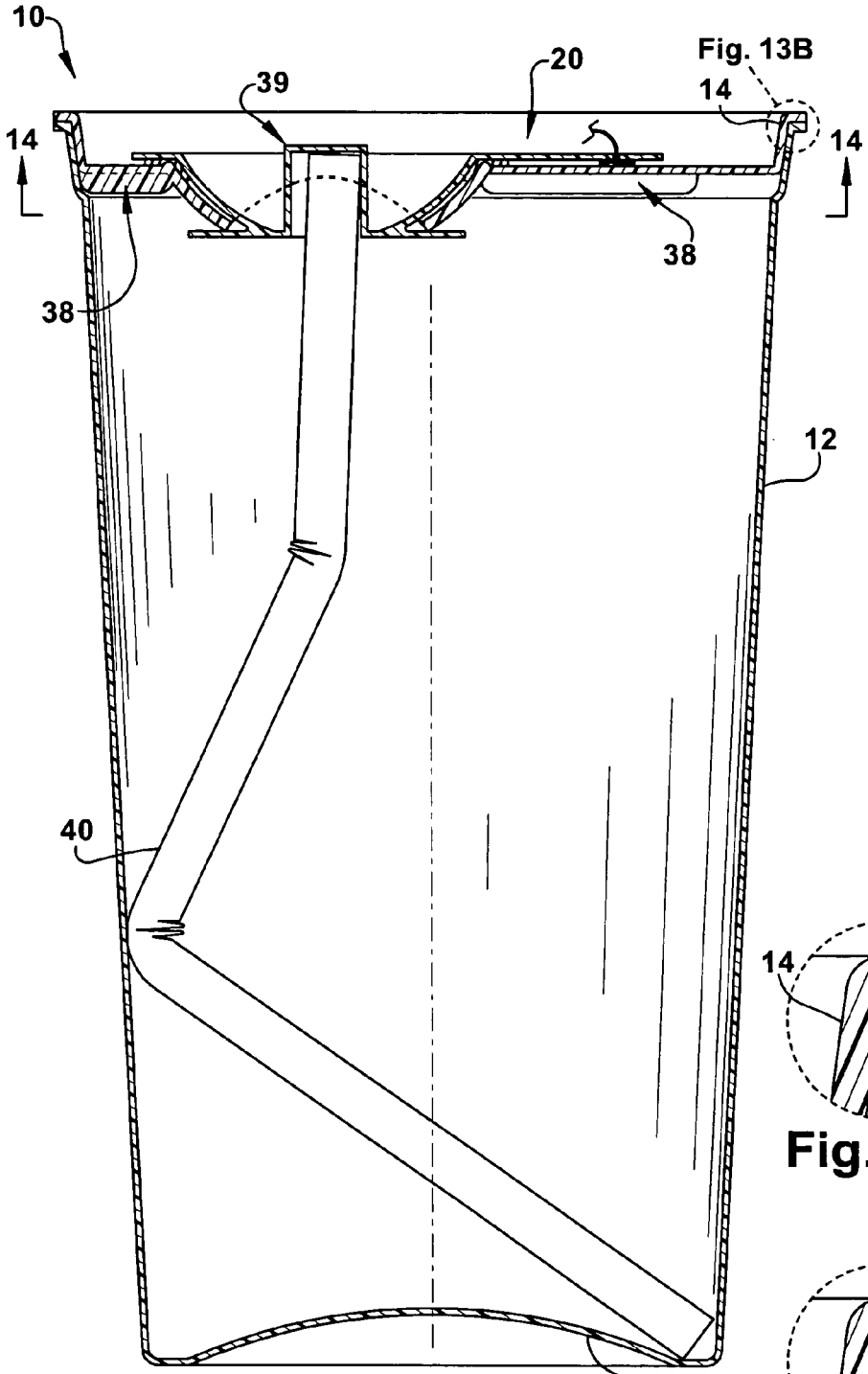
FIG. 13 is a cross section of an alternative embodiment of a beverage container housing a straw assembly.

Referring to the figures, and in particular FIG. 1 depicts a beverage container assembly 10, which is typically sealed after filling. The beverage container 10 includes a lid portion 11 and a body or receptacle 12. In one embodiment, the receptacle 12 is substantially straight, as shown in FIG. 1. In another embodiment, the receptacle 12 may be substantially frustoconical shaped as shown in FIG. 13, diverging gently upwardly. Such configuration provides geometric advantages when storing, shipping, or stacking of the receptacle by allowing the placement of one receptacle inside another. Turning to FIG. 2, the lid portion 11 includes an upstanding annular ridge 13 circumscribing a generally planar main part 14. Located within the main part 14 is an aperture or port 15 for providing a passage to the inside of the beverage container 10. The port 15 coacts to a sealing engagement of an opening assembly 20. A depression 16 is located in the main part 14 for engaging a projection 23 that is attached to the opening assembly 20, which will be discussed later in detail.

The aperture 15 includes an undulating flange 17 on the underside of main part 14 of lid 11 as best seen in FIG. 3. The aperture 15 has a generally noncircular shape, and the flange 17 is substantially inversely proportional to the diameter of the aperture 15 at any point, and hence is at its tallest at the narrow part of the aperture 15, depicted in FIG. 3 at 17*a*. The flange is lowest at the widest part of the aperture 15, as shown in FIG. 3 at 17*b*.

Figure 9:
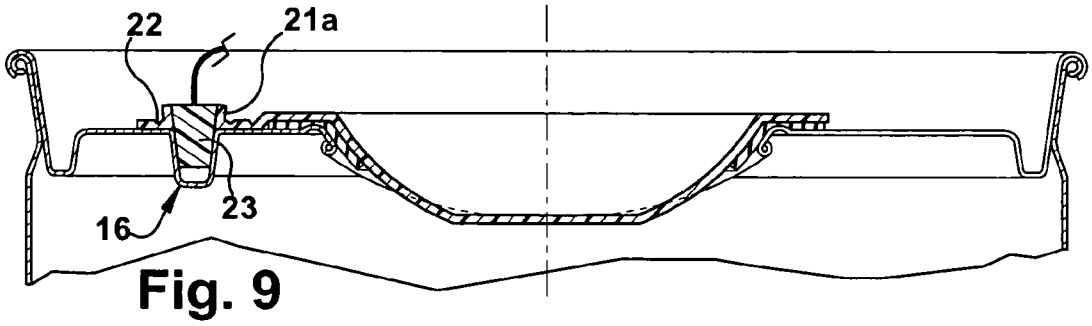
FIG. 9 is a section view of the beverage container of FIG. 7.

A closure member 21 is provided and is part of the opening assembly 20, which in a closed condition is attached to the main part 14 by a breakable seal 22 that is removably attached to an upper part 24 of the closure member. The upper part 24 is generally a circular configuration with an arm 26 projecting therefrom, and also a smaller tab 28, which includes a portion containing the breakable seal 22. The arm 26 acts as a handle to facilitate the handling and rotation of the closure member 21 from a first closed position shown in FIG. 1 to a second opened position shown in FIG. 10. When the arm 26 is rotated, the breakable seal 22 fractures along a weakened portion as best seen in FIG. 9, leaving a fractured section 22*b* of the main section 22*a*, as shown in FIG. 10.

The closure member 21 is oriented in the closed position following the filling of the container 10 to provide for the securing of the content within the beverage container 10. The breakable seal 22 provides reassurance when intact that the beverage container has not been tampered with or opened after filling by the seller. The port 15 and closure member 21 are arranged such that the closure member can be replaced on the port following an initial opening by a consumer to permit subsequent access and securing of the container's contents. The noncircular port 15 and a noncircular engagement member 34 can be rotated from alignment so that fingers 36 cannot pass back through the port 15 and the closure member 21 closes the port 15.

Figure 10:
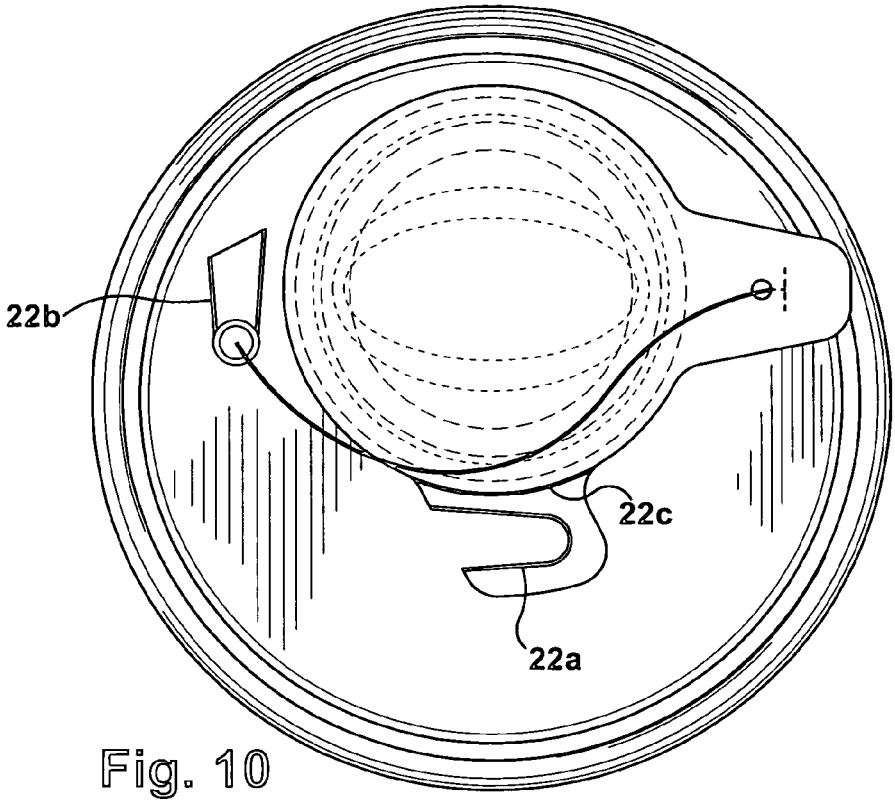
FIG. 10 is a plan view of the beverage container depicting the opening assembly rotated to an open position.
Figure 11:
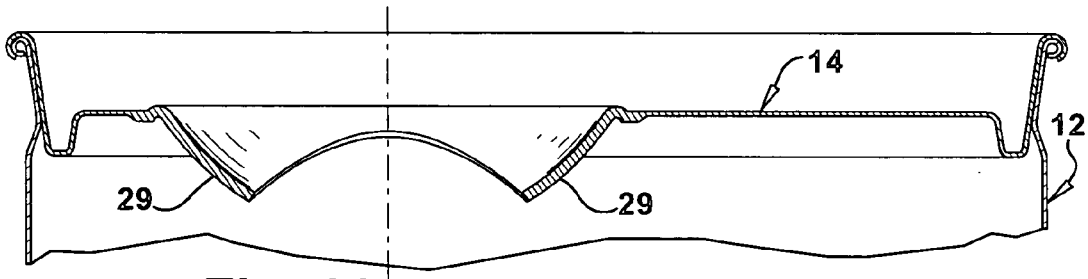
FIG. 11 is a section view of a beverage container depicting an alternative embodiment having an increased reinforcing structure.
Figure 12:
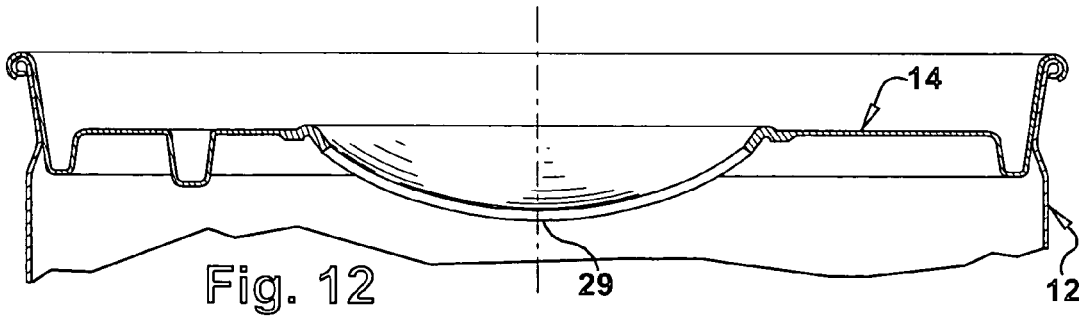
FIG. 12 is a section view of a beverage container depicting an alternative embodiment having an increased reinforcing structure.

In operation, the end user or consumer will open the beverage container 10 by rotating the arm 26, thereby breaking the seal 22 from the upper part 24 of the closure member 21, as shown in FIG. 10. The seal 22 is then retained in a fixed position during the rotation of the closure member 21 by a projection 23 extending from the underside of breakable seal 22. The projection 23 engages the depression 16 in a press-fit connection that is strong enough to withstand removal by a consumer, and as well, the torque resulting from the rotation of the closure member 21 through the arm 26. Extending from, and molded into the projection 23 is a cord 25 that attached to the closure member 21 through an opening 27 in the arm 26. The cord 25 retains closure member 21 to beverage container 10 when the port 15 is open, typically for end-user consumption of the contents. In addition, the cord 25 is designed to break if one attempts to tamper with the beverage container 10, by for example, attempting to remove the projection 23 from the depression 16. The cord 25 can also be broken if the consumer wishes to permanently remove the closure member from the container 10 as a personal preference.

To reassure to the consumer that the beverage container 10 is tamper free, the cord 25 will be intact and the breakable seal remains unfractured. The flush press connection between the projection 23 and both the depression 16 and a flange 21*a* extending from the closure member 21, as shown in FIG. 9 make the removal of the projection 23 impossible without fracturing the breakable seal 22. Security can be further accomplished by having a slight taper to the depression 16. The slight taper can be in the range of 1 to 2 degrees relative to the center of the depression. In addition, the breakable seal includes an extended portion 22*c* that tracks along the profile of the upper part 24. The extended portion 22*c* is designed to rupture should an attempt be made to improperly raise the closure member or eject the projection by an object or device such as a screwdriver, thereby providing a clear indication to a consumer that the container has been corrupted. The extended portion 22*c* could also provide an alternative fracture area when the finger 26 is rotated in order to open the beverage container 10.

On the underside of the upper part 24, an arch shaped body 30 is provided. The arching profile of the body 30 coactively engages with a recessed closure port 31 leading into the aperture 15. Shown in FIGS. 2, 8, 8A, and 8B as being located around the body 30 and against the underside of the upper part 24 is a flexible washer 32, typically made from rubber or neoprene. At a lower most portion of the body member 30 is the engagement member 34 providing the two diametrically opposite radial fingers 36. The flexible washer 32 is held to the body 30 by either a self-adhesive surface on the washer or by having the washer opening diameter sized to be smaller than the fingers 36.

Figure 8A:
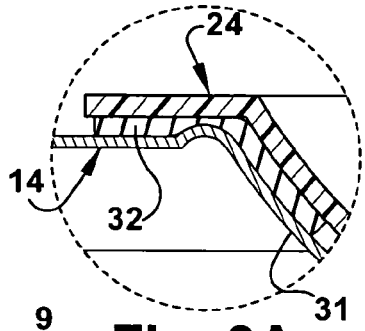
FIG. 8A is an exploded view of the closure member sealing the main part of FIG. 8.
Figure 8B:
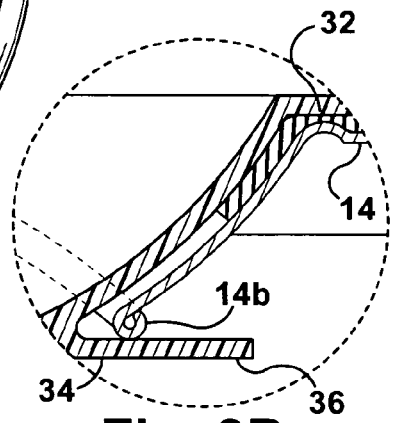
FIG. 8B is an exploded view of an engagement member engaging against a reinforcing portion of the main part.
Figure 8:
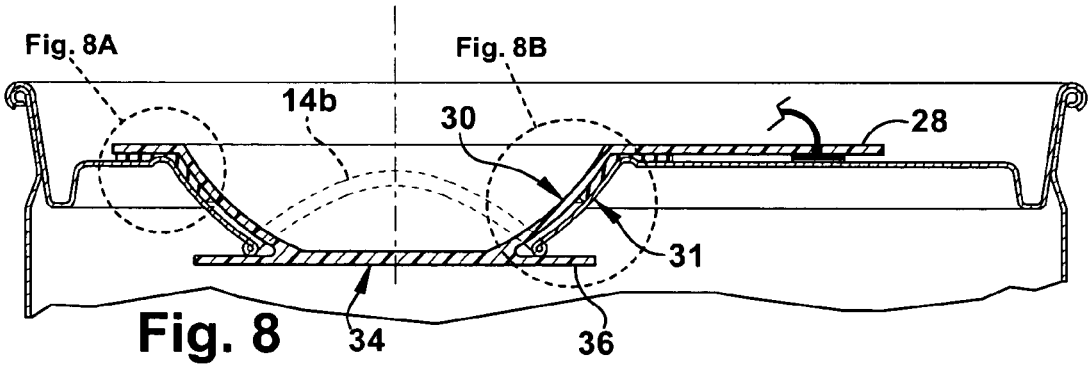
FIG. 8 is a section view of the beverage container of FIG. 7.

The recessed closure port 31 is shaped such that when the closure member 21 is mounted thereon, it does not extend substantially upward beyond the top of the annular ridge 13 as depicted in FIGS. 8 and 9. The current design of the closure member 21 having a low and substantially flat profile will accommodate stacking of the containers 10 during shipping and storage. To further accommodate storage and stacking of the beverage containers 10, the receptacle 12 can include an arched base 33, as shown in FIG. 13. The recessed closure port 31 in one embodiment is domed shaped, which is desirable for filling the beverage container 10 without spilling when being filled by a machine or vat. It should be appreciated by those skilled in the art that nozzles for dispensing beverages can take on several different profiles. Therefore, the recessed closure port 31 and body 30 can be modified accordingly to accommodate such corresponding profiles, for example in another embodiment, the recessed closure port 31 and body 30 are bowl shaped or half spherical. Another advantage of the recessed closure port 31 is that its geometry produces the undulating flange 17 having a high 17*a* and low 17*b* portions without additional manufacturing operations. Further advantages of the recessed closure port 31, include allowing for a larger opening for enhancing easier and faster consuming of the beverage.

The body 12, lid 11 and closure member 21 in one embodiment are made from plastic by an injection mold process or a blow mold operation. In another embodiment, the body, lid and closure member are made from metals such as aluminium or steel or a combination of metal and plastic.

In use, the closure member 21 is preferably configured such that it can only be introduced into, or removed from, the port 15 when the longitudinal direction of the engagement member 34 is at least generally parallel to a first direction of the port, as indicated by arrows A in FIG. 2. The opening assembly 20 is preferably configured such that when the closure member 21 is located in the port 15 in the first direction, it can be rotated to a second direction, as indicated by arrows B in FIG. 2. As a result, the engagement part 34 engages the underside of the main part 14 adjacent the port 15 during transitioning to the second direction.

Figure 13A:
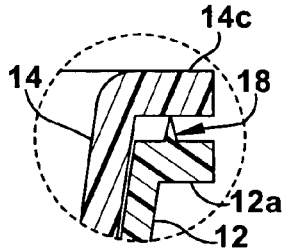
FIG. 13A is an exploded view of FIG. 13 prior to ultrasonic welding.
Figure 13B:
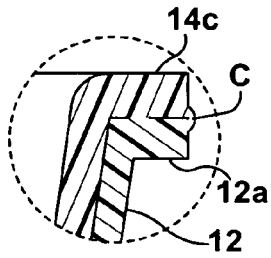
FIG. 13B is an exploded view of FIG. 13 after ultrasonic welding.
Figure 14:
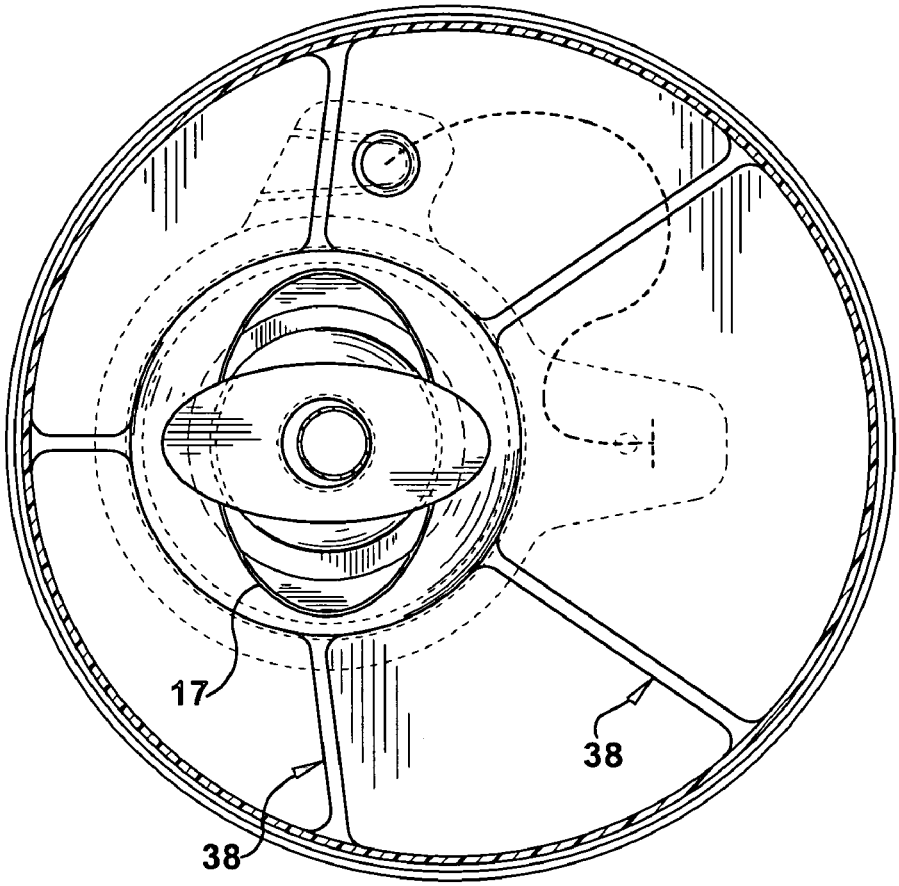
FIG. 14 is a section view of an alternative embodiment of a beverage container depicting rib sections.
Figure 15:
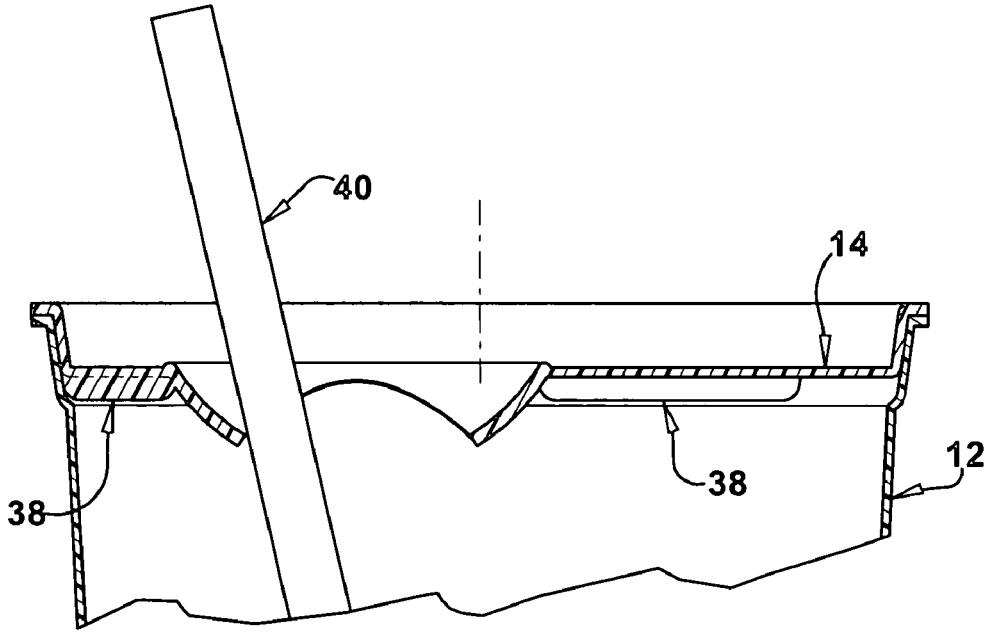
FIG. 15 is a section view of an alternative embodiment depicting an opening assembly having a straw projecting through an aperture in the opening assembly.

The novel opening assembly design allows for several different methods to manufacture, fill, and seal the beverage containers 10. By having a plurality of receptacles 12, main parts 14 including opening assemblies 20, assembly and filling can occur without expensive equipment or significant capital expenditures. For example, the main parts 14 are capable of being attached to the receptacle 12 by an ultrasonic welding machine. The ultrasonic welding process attaches similar materials together as shown in FIGS. 13-15. To facilitate a secure weld between the main part 14 and receptacle 12, the receptacle includes an annular flange 12*a* shown in FIGS. 13A and 13B, which includes a triangular-shaped bead 18 that accelerates the welding time with a corresponding main part flange 14*c*. Ultrasonic energy is transmitted through the flanges under pressure and results in a rapid build-up of heat that causes the bead 18 to melt. As result, the molten material flows across the joint interface C, shown in FIG. 13A forming a molecular bond with the mating surface. In close proximity to the ultrasonic welding apparatus are storage containers automated to have several different beverages to enable a user to choose the desired beverage for automatic filling of the beverage container 10 after welding.

The simplified method of attaching the main part 14 of the lids 11 to the receptacles 12 by ultrasonic welding allows retailers to engage in the assembly process at point-of-sale shops and stores. This significantly reduces the weight and costs of shipping, since the containers 10 are empty during transport. In addition, space requirements are significantly reduced, since the receptacles 12 and lids 11 can be stacked one inside another. Further advantages are achieved by reducing the point-of-sale storage, which typically includes large refrigeration cabinets. The above method of assembly is user friendly to the point that a consumer can select a receptacle 12, place it into the welding apparatus, select the desired beverage, and a lid 11 is welded only a few seconds later, thus making the beverage container 10 now ready for purchasing. Thus, eliminating the labor costs typically incurred by the retailer from the wholesaler plant or factory.

Alternatively, the beverage containers 10 can be shipped to a retailer having the lids 11 preassembled, that is, welded or spin formed to the receptacle 12, as shown in FIGS. 4-6 and 11-12. The retailer is then able to finalize the container filling process and provide to a consumer a secure, tamper-proof beverage container 10. Once the preassembled containers arrive at the retail establishment, the retailer fills the beverage containers 10 through the port 15 with the aid of a beverage nozzle. Once the beverage container 10 is filled to a required level, the opening assembly 20 is inserted through the port 15. The assembly 20 is then rotated to a secured closed position, forcing the arch body 30 to draw the washer 32 to a sealing engagement with the closure port 31 as the fingers 36 of the engagement member 34 pass along an increasingly taller portion of the undulating flange 17. This arrangement urges the main part 14 against the washer 32, which surrounds the closure port 31 to provide a seal. Once the port 15 is sealed, the projection 23 is pressed into the depression 16, completing the filling operation.

Because flange 17 acts as a cam surface for fingers 36, a reinforcing structure 29 is preferred around the flange surface since conventional beverage container lids are typically 0.010" thick, thus relying on material of this thickness alone makes the lid susceptible to deformation. It is therefore desirable to have the cam reinforcing surface surrounding the flange 17 to be a thickness measuring approximately 0.040" to 0.060" thick.

Figure 4:
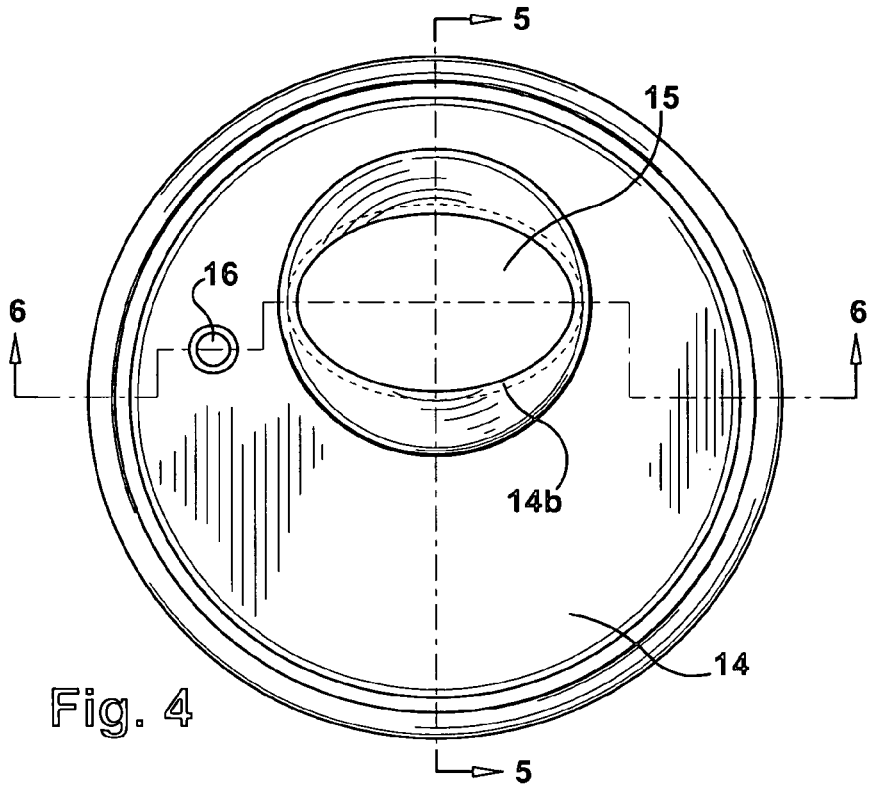
FIG. 4 is a plan view of the beverage container without a closure member.
Figure 5:
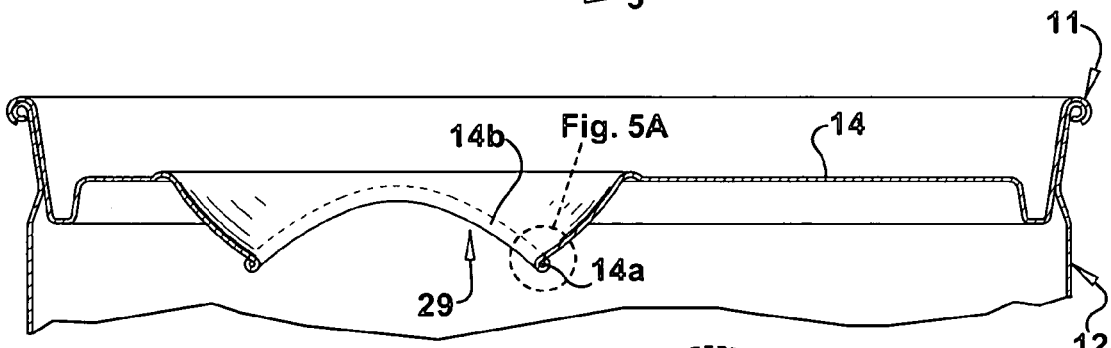
FIG. 5 is a section view of the beverage container of FIG. 4 depicting a reinforcing surface.
Figure 5A:
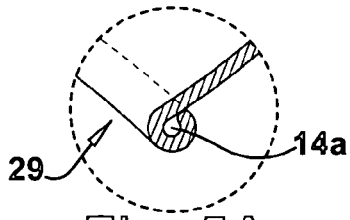
FIG. 5A is an exploded view showing a reinforcing structure of the recessed opening assembly.
Figure 6:
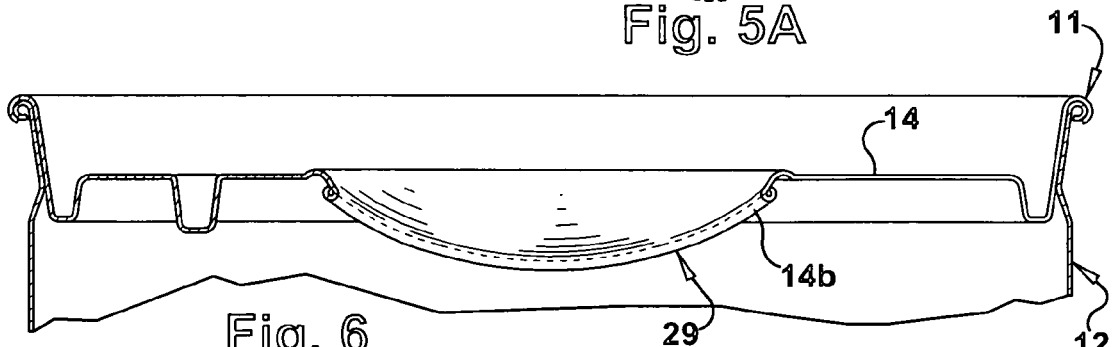
FIG. 6 is a section view of the beverage container of FIG. 4 depicting a reinforcing surface.
Figure 7:
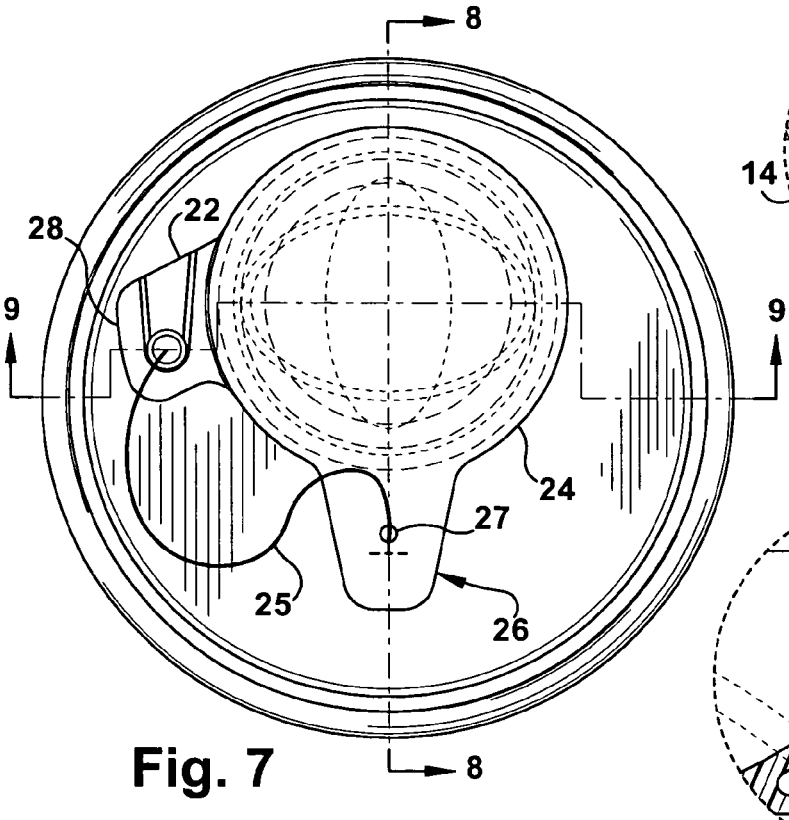
FIG. 7 is a plan view of the beverage container depicting the opening assembly in a closed position.

In one embodiment, the reinforcing structure 29 includes a roll formed lip 14*b* that surrounds the perimeter of the undulating flange 17, as shown in FIGS. 5, 5A, and 6. The lip 14*b* may include a void 14*a* that results from the roll forming process. In an alternative embodiment, the reinforcing structure 29 of the flange 17 can be created by plastic mold injecting, or hot and cold forging techniques to the main part 14. Such techniques result in a greater thickness in the preferred areas that may extend throughout the entire recessed closure port 31, as shown in FIGS. 11-13, and 15. Any of the above processes, being molding or forging can be performed in manufacturing a plastic or metal the main part 14. Additional strength can also be provided if needed to main part 14 by molding, forging or stamping ribs 38 shown in FIGS. 13-15 into main part 14.

In another embodiment, the opening assembly 20 includes a stem 39 for receiving and containing when in a closed position a straw 40. The straw 40 is preassembled within beverage container 10, as shown in FIG. 13. The straw 40 projects through the port 15, and when the opening assembly 20 is removed, as depicted in FIG. 15 and protrudes outwardly for consumer usage. In addition to providing relief for the straw 40 in either a loose or tight fit, the stem 39 facilitates the placing of the opening assembly 20 onto the lid 11 during an automated assembly process, for example by an articulating arm. When the stem 39 is a tight fit, it provides the ability to place the opening assembly 20 and the straw 40 simultaneously into the container 10. The stem 39 can be externally shaped to include a square or hexagonal geometric configuration with a slight taper (not shown) to facilitate the automated turning of the closure member to a closed position after being automatically placed in the aperture 15.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

I claim:

1. A beverage container having an opening assembly for sealing the contents within the container after opening, the opening assembly comprising;

a lid having first and second sides, the lid being attached to a receptacle for containing the beverage contents therein;

a recess located about said first side of said lid, the recess comprising an aperture;

a closure member having first and second portions for coactively engaging said aperture and recess to a sealing engagement the second portion comprising a bowl-shaped body having a substantially concave face;

a breakaway portion secured to the lid to provide security to a consumer and a strap having a first and second end, said first end extending from a projection and said second end passing through an aperture in said closure member, thereby attaching said closure member to the projection; and a depression located in said lid for receiving said projection and securing said closure member to said lid;

whereby a sealing engagement is achieved by inserting said first portion of said closure member' into said aperture of said recess;

wherein said closure member further comprises a substantially convex wall projecting outwardly from the concave face of the bowl-shaped body and defining a recess for housing a straw when the closure member is in the closed position.

2. The opening assembly of claim 1, wherein said recess for housing said straw includes a clearance fit.

3. The opening assembly of claim 1, wherein said recess for housing said straw includes a snug fit for simultaneously placing the closure member and straw into the beverage container.

4. The opening assembly of claim 1, wherein said recess for housing said straw includes an external surface that is hexagonal having a slight taper for manipulating.

5. A beverage container having an opening assembly for sealing the contents within the container after opening, the opening assembly comprising;

a lid having first and second sides, the lid being attached to a receptacle for containing the beverage contents therein;

a recess located about said first side of said lid, the recess comprising an aperture;

a closure member having a first and second portions for coactively engaging said aperture and recess to a sealing engagement;

a breakaway portion secured to the lid to provide security to a consumer and a strap having a first and second end, said first end extending from a projection and said second end passing through an aperture in said closure member, thereby attaching said closure member to the projection; and a depression located in said lid for receiving said projection and securing said closure member to said lid;

whereby a sealing engagement is achieved by inserting said first portion of said closure member into said aperture of said recess;

wherein said aperture further comprises an undulating flange comprising a reinforced structure for providing a cam surface for engaging said second portion of the closure member.

* * * * *